US010167618B2

(12) United States Patent
Kashirajima et al.

(10) Patent No.: US 10,167,618 B2
(45) Date of Patent: Jan. 1, 2019

(54) FLUSH TOILET

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Masaki Kitamura, Kitakyushu (JP)

(73) Assignee: TOTO LTD., Kitakyushi-shi, Fukuoka (JP)

( * ) Notice: Subject to any disclaimer, the term of this patent is extended or adjusted under 35 U.S.C. 154(b) by 27 days.

(21) Appl. No.: 15/255,919

(22) Filed: Sep. 2, 2016

(65) Prior Publication Data

US 2017/0067241 A1 Mar. 9, 2017

(30) Foreign Application Priority Data

Sep. 9, 2015 (JP) ..... 2015-177408

(51) Int. Cl.
*E03D 11/08* (2006.01)
*E03D 11/06* (2006.01)
*E03D 11/13* (2006.01)

(52) U.S. Cl.
CPC ..... *E03D 11/08* (2013.01); *E03D 11/06* (2013.01); *E03D 11/13* (2013.01); *E03D 2201/40* (2013.01)

(58) Field of Classification Search
USPC ..... 4/420
See application file for complete search history.

(56) References Cited

U.S. PATENT DOCUMENTS

2007/0277302 A1* 12/2007 Ichiki ..... E03D 11/08 4/420
2010/0154107 A1 6/2010 Wu
2010/0186158 A1 7/2010 Morita et al.
2013/0047329 A1 2/2013 Yamasaki et al.

FOREIGN PATENT DOCUMENTS

CN 1408040 A 4/2003
CN 102953424 A 3/2013
JP 2013-044177 A 3/2013
TW 200920901 A 5/2009

OTHER PUBLICATIONS

Taiwanese Office Action dated Sep. 13, 2017.
European Search Report issued in European Patent Application No. 16187502.6 dated Nov. 17, 2016.
Chinese Office Action for CN 201610658553.3 dated Jun. 5, 2018.

* cited by examiner

*Primary Examiner* — Lauren Crane
(74) *Attorney, Agent, or Firm* — Baker & Hostetler LLP

(57) ABSTRACT

A flush toilet for cleaning a toilet main body and discharging waste by using flush water is disclosed. The flush toilet contains a bowl portion including a bowl shaped waste-receiving surface and a rim portion formed on a top edge of the waste-receiving surface, the rim portion having an inner circumferential surface whose top portion is configured to rises vertically. The bowl portion contains a front region, the front region includes a first arc-shaped surface having a curvature R1 in a horizontal direction of a top portion of the waste-receiving surface and a second arc-shaped surface having a curvature R2 in a vertical direction formed by the inner circumferential surface of the rim portion and the waste-receiving surface, and the ratio of the curvature R1 to the curvature R2 is in a range of 1:3 to 3:1.

4 Claims, 3 Drawing Sheets

FLUSH TOILET

TECHNICAL FIELD

The present invention relates to a flush toilet, and in particularly to a flush toilet for cleaning a toilet main body and discharging waste by using flush water supplied from a flush water source.

BACKGROUND ART

As disclosed in Patent Document 1 (JP-2013-44177A), a conventional flush toilet comprises a bowl portion including a bowl-shaped waste-receiving surface, a rim portion formed along the top edge portion of the bowl portion, and a shelf portion formed over essentially the entire circumference thereof, between the waste-receiving surface and the rim portion. In the flush toilet, flush water spouted from a spout port flows so as to circulate over the shelf portion while maintaining a relatively strong flow force, and circulates on the entire waste-receiving surface.

SUMMARY OF THE INVENTION

Technical Problems

In recent years, there has been an increase in the number of males who even for urination alone choose to urinate from a sitting position rather than a standing position, and when males or females urinate sitting on a toilet, the problem arises that the user's urine may hit a shelf portion at the front of the bowl portion, or a waste-receiving surface projecting inward, splashing upward of the bowl portion or outside the bowl portion, or bouncing back onto the user seated above the bowl portion, or spraying or flowing from the top edge of the rim portion to outside the bowl portion.

More specifically, at the front portion of a bowl portion according to the conventional flush toilet disclosed in Patent Document 1, the shelf portion is formed to project horizontally from the inner circumferential surface at the front surface of the bowl portion. When urine drops from diagonally above and collides with the shelf portion in this manner, the shelf portion functions to bounce the urine back, causing the problem that urine is susceptible after hitting to spraying upward of the shelf portion, or upward and to the side, or onto the user.

Therefore, at the front portion of the bowl portion of the conventional flush toilet such as that shown in Patent Document 1, if urine splashing occurs when male or female urine hits the waste-receiving surface due to the formation of the top edge portion of the rim portion into an inwardly projecting overhanging shape, the splashing of the urine can be made to hit the top edge portion of the rim portion, thereby limiting the urine from splashing as far as outside the toilet.

On the other hand, investigations are underway into forming the inner circumferential surface of a rim portion at the side or rear region of a toilet main body into a vertically rising shape, thereby raising the visibility of the bowl portion interior to be higher than a rim portion with an overhang shape in which the top edge portion projects inward, such that the bowl portion appears wider, and the user has a greater sense of ease of use and assuredness when using the toilet. Consideration is also being given to forming the top edge portion of a rim portion thus rising vertically to have a sloped surface, so that its inner side slopes downward, thereby improving cleaning ability of the rim portion compared to of a rim portion with an overhang shape.

If a rim portion thus formed to rise in the plumb direction is used at the front portion of the bowl portion, the rim portion is not formed in an overhang shape, so bounce-back of user urine to the top of the bowl portion and/or outside the bowl portion, or bounce-back to the user him/herself sitting over the bowl portion, or spraying or outflow from the top edge of the rim portion to outside the bowl portion, becomes a pronounced problem.

It is therefore an object of the present invention to provide a flush toilet with which bounce-back of urine hitting the inside surface of a bowl portion can be relatively constrained, and bounce-back of user urine to the top of the bowl portion and/or outside the bowl portion, or bounce-back to the user him/herself sitting over the bowl portion, or spraying or outflow from the rim portion to outside the bowl portion, can be constrained.

Solution to Problems

The above object is achieved according to the present invention by providing a flush toilet for cleaning a toilet main body and discharging waste by using flush water supplied from a flush water source, comprising: a bowl portion including a bowl shaped waste-receiving surface and a rim portion formed on a top edge of the waste-receiving surface, the rim portion having an inner circumferential surface whose top portion is configured to rises vertically; a discharge path configured to discharge the waste, an inlet of the discharge path being connected to a bottom of the bowl portion; a spouting portion configured to spout the flush water to the bowl portion and form a circulating flow of the flush water; a water conduit configured to supply the flush water to the spouting portion; and a water supply apparatus for supplying the flush water to the water conduit; wherein the bowl portion contains a front region, the front region includes a first arc-shaped surface having a curvature R1 in a horizontal direction of a top portion of the waste-receiving surface and a second arc-shaped surface having a curvature R2 in a vertical direction formed by the inner circumferential surface of the rim portion and the waste-receiving surface, and the ratio of the curvature R1 to the curvature R2 is in a range of 1:3 to 3:1.

In the present invention thus constituted, in the front region of the bowl portion where user urine is prone to hit, no inwardly projecting part, such as a shelf-shaped projecting part, is formed; the ratio of the curvature R1 on the first arc-shaped surface in the horizontal direction of the top portion of the waste-receiving surface to the curvature R2 on the second arc-shaped surface in the vertical direction formed by the inner circumferential surface of the rim portion and the waste-receiving surface is in the range of 1:3 to 3:1; and the arc-shaped surface formed so that its interior is concave in the same manner in both the horizontal and vertical directions, can relatively constrain the bounce back of urine hitting the bowl portion inner surface. Therefore bounce-back of user urine to the top of the bowl portion and/or outside the bowl portion, or bounce-back to the user him/herself sitting over the bowl portion, or spraying or outflow from the top edge of the bowl portion to outside the bowl portion, can be constrained.

In the present invention, preferably, the front region of the bowl portion is formed in a region within a center angle range from 20° through 100° using an origin point as a center, the origin point being defined by an intersection of a front-to-back axial line dividing an bowl opening of the bowl portion into two equal parts left and right with a left-to-right axial line dividing the bowl opening into two equal parts front and back.

In the present invention thus constituted, the front region of the bowl portion where a urinating user's urine is most prone to hit is formed in the region within a center angle range from 20° through 100°, centered on the origin point. In such a front region of the bowl portion, no inwardly projecting part such as a shelf-shaped projecting part is formed, and the arc-shaped surface formed so that its interior is concave in the same manner in both the horizontal and vertical directions, can relatively constrain the bounce back of urine hitting the bowl portion inner surface. Therefore bounce-back of user urine to the top of the bowl portion and/or outside the bowl portion, or bounce-back to the user him/herself sitting over the bowl portion, or spraying or outflow from the rim portion to outside the bowl portion, can be constrained.

In the present invention, preferably, the curvature R1 and the curvature R2 are formed to be substantially the same.

In the present invention thus constituted, in the front region of the bowl portion where user urine is prone to hit, no inwardly projecting part, such as a shelf-shaped projecting part, is formed; the curvature R1 on the first arc-shaped surface and the curvature R2 on the second arc-shaped surface are formed to be substantially the same, therefore bounce-back of urine hitting the surface of the bowl portion can be more reliably constrained. Hence bounce-back of user urine to the top of the bowl portion and/or outside the bowl portion, or bounce-back to the user him/herself sitting over the bowl portion, or spraying or outflow from the rim portion to outside the bowl portion, can be more reliably constrained.

In the present invention, preferably, the rim portion includes a rim top surface portion forming a top surface of the rim portion, a rim outer wall portion forming an outer circumference surface of the rim portion, and a rim inner wall portion forming an inner circumference surface of the rim portion; and wherein, in the front region of the bowl portion, the rim outer wall portion has a sloped surface in which a top region of the rim outer wall portion slopes downward, the rim inner wall portion has a sloped surface in which a top region of the rim inner wall portion slopes downward, and a horizontal width of the sloped surface of the rim inner wall portion is formed to be larger than a horizontal width of the sloped surface of the rim outer wall portion.

In the present invention thus constituted, when the horizontal width of the sloped surface of the top region of the rim inner wall portion is formed to be larger than the horizontal width of the sloped surface of the top region of the rim outer wall portion, and an effort is made to improve user visual awareness so that the top portion of the waste-receiving surface is perceived to expand outward, and to improve the cleaning ability of the front region of the bowl portion within the rim inner wall portion, then within the rim inner wall portion, the sloped surface of the rim inner wall is formed at the top portion of the rim inner wall portion in the front region of the bowl portion front region, therefore the height of the top portion of the inner circumferential surface rising essentially vertically on the rim portion is formed to be relatively low, so to that extent urine sprays or flows out more easily to areas outside the bowl portion. The arc-shaped surface, formed to be concave in the same manner in both the horizontal and vertical directions, can relatively constrain the bounce-back of urine hitting the inner surface of the bowl portion even in flush toilets comprising a rim portion with the type of rim inner wall top sloped surface. Therefore bounce-back of user urine to the top of the bowl portion and/or outside the bowl portion, or bounce-back to the user him/herself sitting over the bowl portion, or spraying or outflow from the rim portion to outside the bowl portion, can be constrained.

Advantageous Effect of the Invention

According to the flush toilet of the present invention, bounce-back of urine hitting the inside surface of the bowl portion can be relatively constrained, and bounce-back of user urine to the top of the bowl portion and/or outside the bowl portion, or bounce-back to the user him/herself sitting over the bowl portion, or spraying or outflow from the rim portion to outside the bowl portion can be constrained.

DESCRIPTION OF EMBODIMENTS

Next, referring to the attached drawings, a flush toilet according to a first embodiment of the present invention will be explained.

Figure 1:
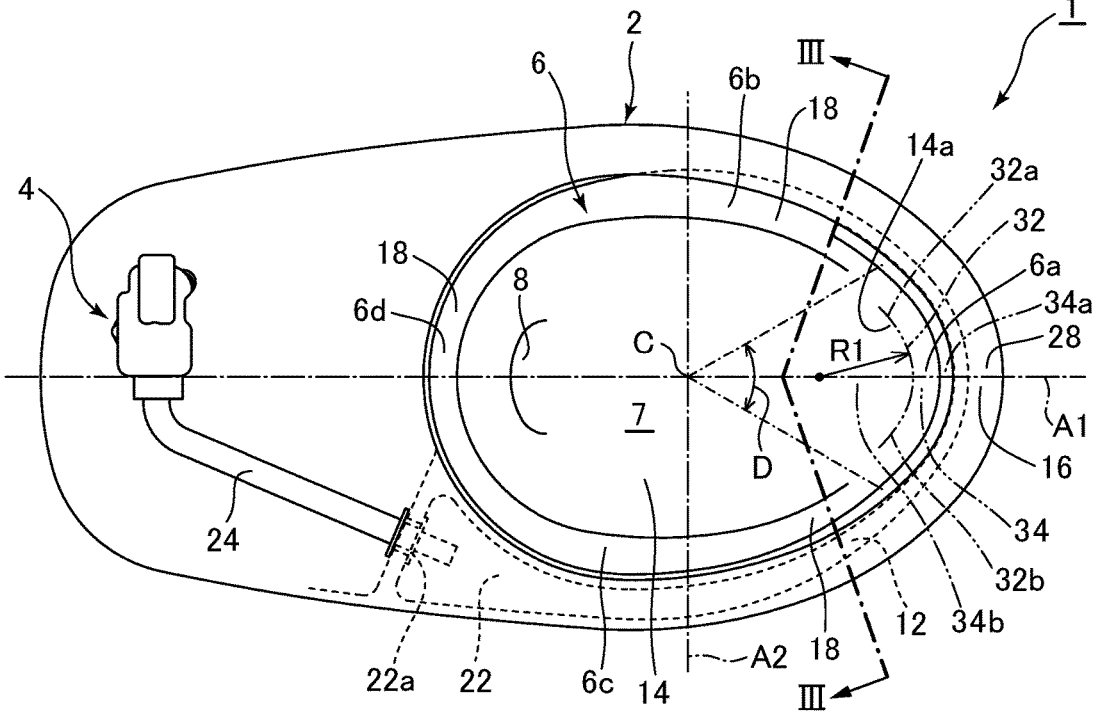
FIG. 1 is a plan view showing a flush toilet whose toilet seat and water supply apparatus are removed therefrom according to a first embodiment of the present invention.
Figure 2:
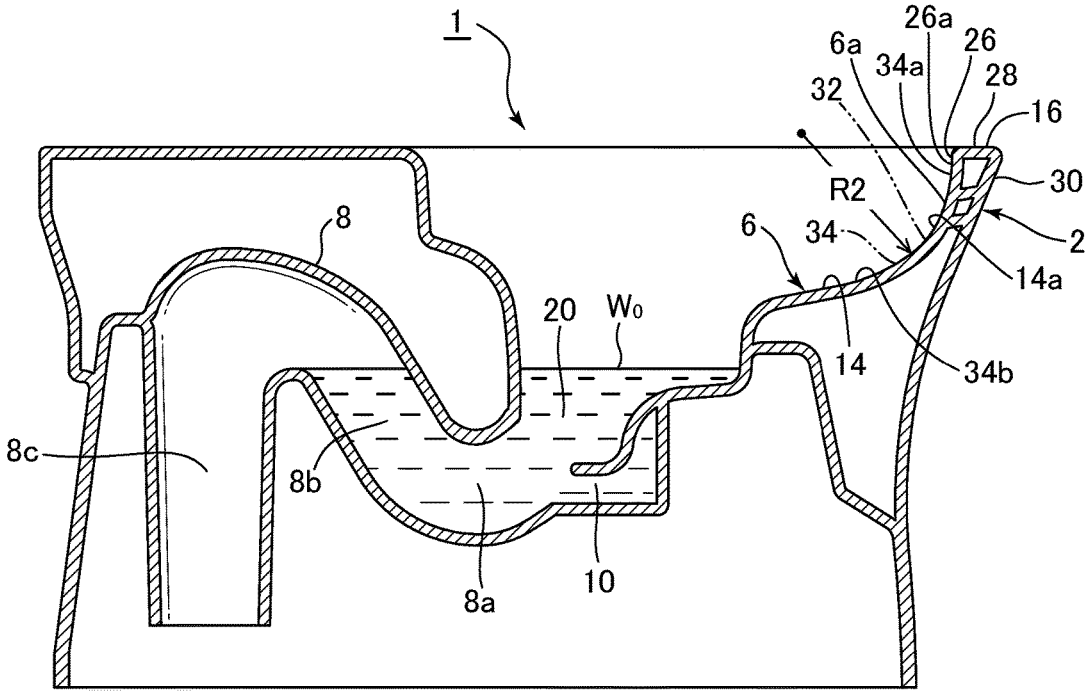
FIG. 2 is a sectional view along a center cross section of the main body of a flush toilet according to a first embodiment of the present invention.
Figure 3:
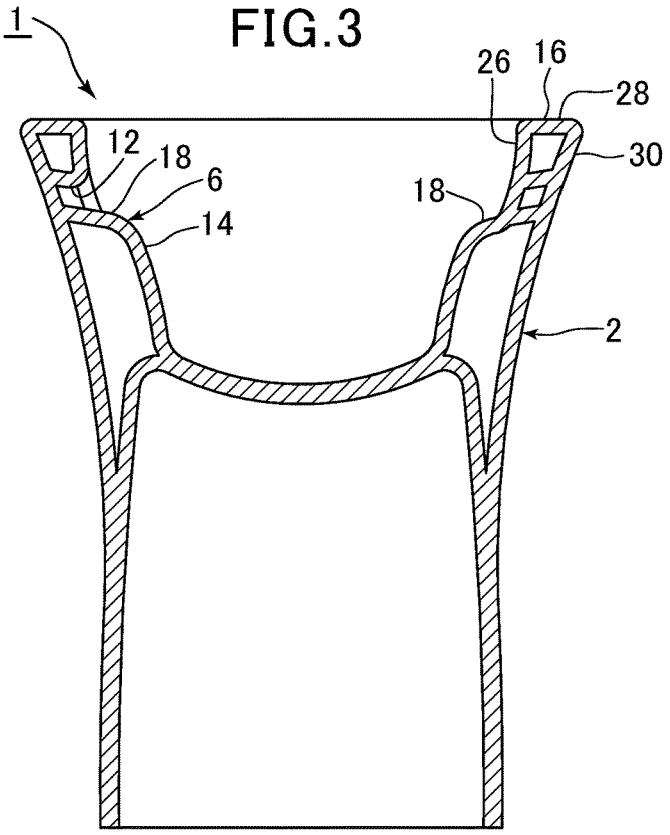
FIG. 3 is a cross sectional view seen along a line III-III in FIG. 1.

First, referring to FIGS. 1 through 3, the structure of a flush toilet according to a first embodiment of the invention is explained. Here, FIG. 1 is a plan view showing a flush toilet whose toilet seat and water supply apparatus are removed therefrom according to a first embodiment of the present invention, FIG. 2 is a sectional view along a center cross section of the main body of a flush toilet according to a first embodiment of the present invention, and FIG. 3 is a cross sectional view seen along a line III-III in FIG. 1.

Below, in explaining an embodiment of the present invention, the closest side as seen by a user using the toilet main body 2 is the front side, the side seen as the far side from the user is the rear side, the side of the toilet main body 2 seen from the front on the right is the right side, and the side of the toilet main body 2 seen from the front on the left is the left side.

As shown in FIGS. 1 and 2, the flush toilet 1 according to a first embodiment of the present invention comprises a toilet main body 2, a toilet seat (not shown) disposed on the top surface of the toilet main body 2, and a water supply apparatus 4 disposed at the rear of the toilet main body 2.

The toilet main body 2 is made of ceramic, and a bowl portion 6 for receiving waste, a discharge trap pipe 8

(discharge path) extending from the bottom portion of the bowl portion 6, a jet spout port 10 for jet spouting, and a single rim spout port 12 (spout portion) for rim spouting are formed on the toilet main body 2.

The jet spout port 10 is formed at the bottom portion of the bowl portion 6; it is directed essentially horizontally at an inlet of the discharge trap pipe 8, and jets out flush water toward the discharge trap pipe 8.

The rim spout port 12 is formed in a region to the left and in front of the bowl portion 6, in front of a front region 6*a* of the bowl portion 6, and jets out flush water toward the front along the edge of the bowl portion 6. The rim spout port 12 is formed to spout flush water into the bowl portion 6 and form flush water in the bowl portion 6 into a circulating flow on the waste-receiving surface 14. The rim spout port 12 is formed at the bottom portion of the rim portion 16, and above the waste-receiving surface 14. In the vicinity of the rim spout port 12, the bottom surface of the rim spout port 12 flow path forms a flat surface connecting with the shelf portion 18. In the embodiment of the present invention, in parts other than the front region 6*a* of the bowl portion 6, the rim spout port 12 is formed in the left front region of the bowl portion 6, but the rim spout port 12 may be formed in other regions among parts other than the front region 6*a* of the bowl portion 6; for example, it may be formed in the left rear region of the bowl portion 6 so as to spout flush water toward the front, or may be formed in the right front region of the bowl portion 6 so as to spout flush water toward the rear.

Note that, in the embodiment of the present invention, a jet spout port 10 is formed on the toilet main body 2, but the present invention is not limited thereto; for example, it is also acceptable, out of the jet spouting port and the rim spouting port, for only a rim spout port to be formed, and no jet spouting port to be formed.

The discharge trap pipe 8 includes an inlet portion 8*a*, a trap riser pipe 8*b* rising from this inlet portion 8*a*, and a trap descending pipe 8*c* descending from the trap riser pipe 8*b*.

The flush toilet 1, according to the first embodiment, is directly connected to a water utility supplying flush water; flush water is ejected from the rim spout port 12 by the water utility supply pressure. For the jet spout, flush water stored in a storage tank (not shown) built into the water supply apparatus 4 is pressurized using a pressurizing pump (not shown) and jetted out in large quantities from the jet spout port 10.

The flush toilet 1 in the present embodiment is a hybrid-type of flush toilet having a hybrid-type (utility water direct pressure+tank water supply type) water supply apparatus with which, for rim spouting, the toilet is flushed by supplying water at water utility water pressure (direct pressure), and for jet spouting, jetting is caused to occur from a jet spout port 10 by pressurizing flush water stored in a storage tank (not shown) using a pressuring pump (not shown).

In addition, the flush toilet 1 water supply apparatus 4 may also be applied for purposes other than a hybrid-type water supply apparatus. For example, a water utility direct pressure type of flush toilet comprising only a water utility direct pressure type of water supply apparatus whereby water is supplied using water utility water pressure, or a tank-type flush toilet comprising a gravity-feed storage tank, or a flush toilet in which water is supplied by a flush valve system, or by using supplementary pump pressure, are also acceptable. A water supply apparatus of the type whereby flush water is supplied to the toilet using an accumulator or the like is also acceptable.

The bowl portion 6 comprises a waste-receiving surface 14 formed in a bowl shape, a rim portion 16 formed over the top outer side of the entire circumference of the bowl portion 6 and forming the top portion edge of the toilet main body 2, and a shelf portion 18 formed between the waste-receiving surface 14 and the rim portion 16. A pooled water portion 20 is formed at the bottom of the bowl portion 6. In the pooled water portion 20, flush water is accumulated up to a predetermined amount after each flushing, and a pooled water surface $W_0$ is formed. An inlet portion 8*a* is opened in the above-described discharge trap pipe 8 at the bottom of the pooled water portion 20, and the bottom end of the discharge trap pipe 8 trap descending pipe 8*c* is connected through a discharge socket (not shown) to an under-floor discharge pipe (not shown). Note that in the present embodiment the bottom end of the trap descending pipe 8*c* is connected through a discharge socket to an under-floor discharge pipe, but the invention is not limited to such forms and, for example, the bottom end of the trap descending pipe may also be connected to an under-floor discharge pipe without going through a discharge socket, or may be connected through or not through a discharge socket to a discharge pipe rising above the floor.

A bowl opening 7 is formed on the inside of the rim portion 16 formed at the top outside of the entire circumference of the bowl portion 6.

A water conduit 22 extends forward from an inlet portion 22*a* connected to a rim-side water supply path 24 extending from the water supply apparatus 4, and communicates with the rim spout port 12 opening toward the front on the left side of the front region of the bowl portion 6. The rim spout port 12 is positioned on the front side relative to a left-to-right axial line extending in the left-to-right direction, which equally divides the bowl portion 6 in two parts front-to-back.

The rim spout port 12 spouts flush water forward from the front region of the bowl portion 6 and forms a flow toward the front region 6*a* of the bowl portion 6; the flush water is then further returned from the front region 6*a* of the bowl portion 6, forming a flow toward the rear over the shelf portion 18 on the opposite side of the bowl portion 6 rim spout port 12.

Flush water spouted from the rim spout port 12 is formed into a circulating flow spouted from the rim spout port 12 in the toilet forward direction over the shelf portion 18 between the rim portion 16 and the waste-receiving surface 14, or over a rim inside wall portion 26 on the rim portion 16; the circulating flow is formed into a descending flow which flows downward as it circulates from the rim inside wall portion 26 of the rim portion 16 over the waste-receiving surface 14 in the direction of the pooled water portion 20.

Next, referring to FIGS. 1 through 3, details of the rim portion 16 are explained.

The rim portion 16 comprises: a rim inside wall portion (inner circumferential surface) 26 which forms the inner circumferential surface of the rim portion 16, in which all or a portion from the top end 14*a* of the waste-receiving surface 14 to the peak portion of the toilet main body 2 is formed into a vertical wall shape rising vertically; a rim top surface portion 28 forming the top surface of the rim portion 16; and a rim outer wall portion 30 forming the outer circumferential surface of the rim portion 16 and formed into a vertical wall shape rising up the outer surface of the toilet main body 2 up to the rim top surface portion 28.

The rim inside wall portion 26 is formed over the entire circumference on the inside of the rim portion 16, and is formed to rise in essentially the vertical direction in most regions. Note that cases in which the rim inside wall portion 26 is formed to rise in essentially the vertical direction include cases in which the top portion of all or a part of the rim inside wall portion 26 is formed into a shape which slightly overhangs toward the inside of the bowl portion 6, as well as cases in which the top portion of all or a part of the rim inside wall portion 26 has a slope such that it spreads slightly toward the outside of the bowl portion 6.

Cases in which the rim inside wall portion 26 is formed to rise in essentially the vertical direction include cases in which, in the height direction, a portion of the rim inside wall portion 26 is formed to rise in essentially the vertical direction.

The shelf portion 18 forms a flat surface extending laterally between the rim portion 16 and the waste-receiving surface 14. As shown in FIG. 3, when viewed from above the bowl portion 6, the shelf portion 18 is formed to project inwardly from the bottom end of the rim portion 16 at the bottom end of the rim portion 16 and at the top edge of the waste-receiving surface 14. The formation of a flat shelf portion 18 in the lateral direction between the rim portion 16 and the waste-receiving surface 14 makes it easier for flush water to mount the shelf portion 18 and to circulate over the shelf portion.

The shelf portion 18 is formed in parts of the bowl portion 6 other than the front region 6*a* of the bowl portion 6, i.e., in the right side region 6*b* and left side region 6*c* behind the front region 6*a* of the bowl portion 6, and in the rear region 6*d* thereof. Therefore after passing through the front region 6*a* of the bowl portion 6, flush water spouted from the rim spout port 12 flows from the shelf portion 18 of the right side region 6*b* over the shelf portion 18 of the rear region 6*d*, and flows more easily so as to circulate to the shelf portion 18 on the left side region 6*c*. As described below, no shelf portion 18 is formed in the front region 6*a* of the bowl portion 6. Thus even in cases where a shelf portion 18 is formed in the front region 6*a* of the bowl portion 6, flush water is formed to flow easily so as to circulate over the shelf portion 18 at the top edge of the waste-receiving surface 14, hence flush water flowing down from the shelf portion 18 can be easily formed into a circulating flow on the waste-receiving surface 14, and the waste-receiving surface 14 can be continuously flushed clean.

The shelf portion 18 performs the function of forming flush water spouted from the rim spout port 12 into a circulating flow so as to circulate on the entirety of the waste-receiving surface 14. In the embodiment of the present invention, in the front region 6*a* of the bowl portion 6, a first arc-shaped surface 32 of the waste-receiving surface 14 is formed, without forming a shelf portion 18, and by forming a shelf portion 18 in a region other than the front region 6*a* of the bowl portion 6, flush water spouted from the rim spout port 12 can be formed into a circulating flow which circulates over the entire waste-receiving surface 14.

Next, referring to FIGS. 1 through 3, details of the front region 6*a* of the bowl portion 6 are explained.

Adopting the intersection between a front-to-back axial line A1 equally dividing the bowl opening 7 of the bowl portion 6 into two parts left-to-right and a left-to-right axial line A2 equally dividing the bowl opening 7 into two parts front-to-back as origin point (center point) C, the front region 6*a* of the bowl portion 6 is formed within a center angle range from 20° though 100° using an origin point C as a center, and within an angle region D, being a range which is left-right symmetrical relative to the front-to-back axial line A1.

In the front region 6*a* of the bowl portion 6, the plumb portion 26*a* at the top portion of the rim inside wall portion 26 is formed to rise in essentially the vertical direction. In the front region 6*a* of the bowl portion 6, a spherical curved surface is formed by the rim inside wall portion 26 of the rim portion 16 on the bottom side from the plumb portion 26*a* of the rim inside wall portion 26, rising essentially vertically, and the waste receiving surface 14. In the region where the spherical curved surface of the front region 6*a* of the bowl portion 6 is formed, the shelf portion 18 is omitted, making a region in which no raised or stepped part, etc. of the type projecting from the rim inside wall portion 26 of the rim portion 16 or the waste-receiving surface 14 toward in the inner side of the bowl portion 6 is formed. The spherical curved surface forms a curved surface projecting toward the outside of the bowl portion 6 (on the front side of the toilet main body 2), and forms a curved surface curving so as to indent toward the inside of the bowl portion 6. In the front region 6*a* of the bowl portion 6, no part projecting on the inside of the bowl portion 6 is formed, so that urine hitting the front region 6*a* can easily spread out along the front region 6*a*, and even if urine hitting the front region 6*a* does bounce back from the front region 6*a*, it can easily bounce from the front region 6*a* toward the inside and downward in the bowl portion 6.

As shown in FIG. 1, in the front region 6*a* of the bowl portion 6, in the horizontal direction, a first arc-shaped surface 32 is formed in the horizontal direction close to the top end 14*a* of the waste-receiving surface 14.

The first arc-shaped surface 32 is formed as a compound arc in which multiple arcs, curves, or straight lines are connected, but may also be formed by a single arc. Because the first arc-shaped surface 32 is formed as a compound arc in which multiple arcs, curves, or straight lines are connected, the curvature R1 of the first arc-shaped surface 32 is defined as approximately the curvature along the first arc-shaped surface 32. The first arc-shaped surface 32 is formed to describe an arc projecting toward the outside of the bowl portion 6.

As shown in FIGS. 1 and 2, in the front region 6*a* of the bowl portion 6, in the vertical direction, a second arc-shaped surface 34 is formed by the bottom side below the plumb portion 26*a* of the rim inside wall portion 26, the plumb portion 26*a* being formed to rise essentially vertically, and the waste-receiving surface 14. The second arc-shaped surface 34 is formed as a compound arc in which multiple arcs, curves, or straight lines are connected. Because the second arc-shaped surface 34 is formed as a compound arc in which multiple arcs, curves, or straight lines are connected, the curvature R2 of the second arc-shaped surface 34 is defined as approximately the curvature along the second arc-shaped surface 34. The second arc-shaped surface 34 is formed to describe an arc projecting toward the outside of the bowl portion 6. In the embodiment of the present invention, the a second arc-shaped surface 34 is formed at the bottom end of the plumb portion 26*a*, but as a variant example, a plumb portion could also be formed so that the top end of the second arc-shaped surface 34 extends in a plumb direction.

Figure 4:
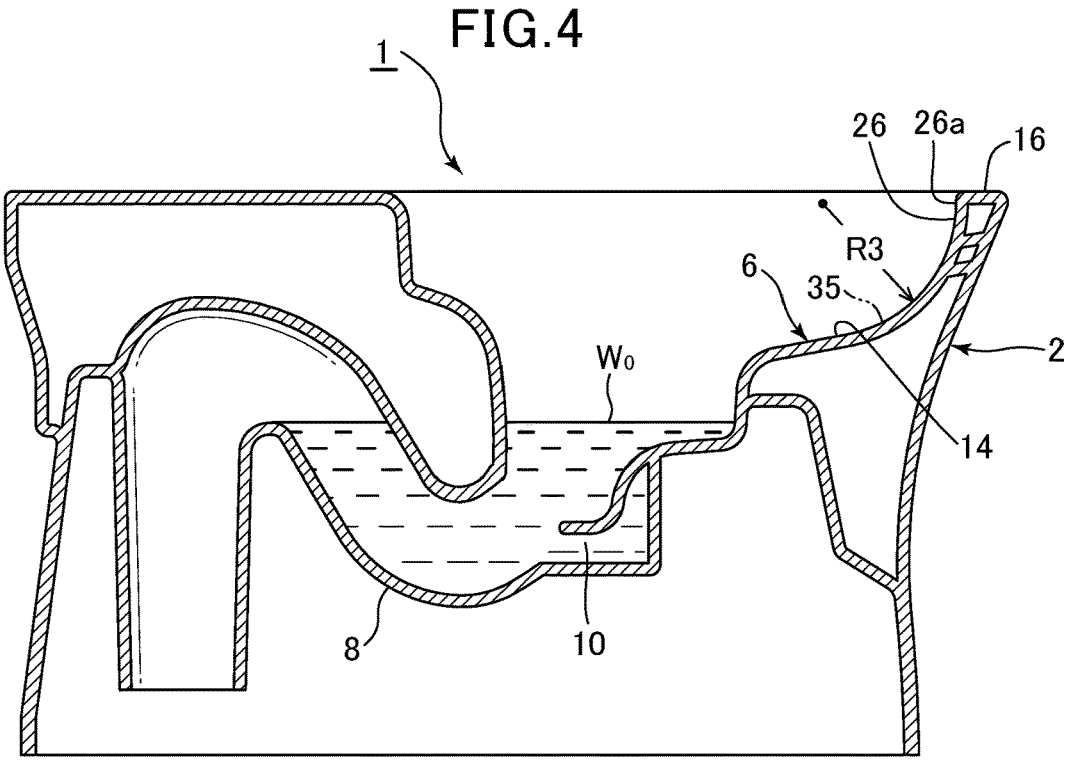
FIG. 4 is a cross sectional view seen along a center cross section of the main body of a flush toilet, showing a variant example of the front region of a bowl portion in a flush toilet according to a first embodiment of the invention.

In the embodiment of the present invention, the second arc-shaped surface 34 is formed as a compound arc in which multiple arcs, curves, or straight lines are connected, but as a variant example a second arc-shaped surface 35 could also be formed as only a single arc, as shown in FIG. 4. In the variant example, the second arc-shaped surface 35 formed by the bottom side below the plumb portion 26*a* of the rim inside wall portion 26 and the waste-receiving surface 14 can be formed into a smoother shape along only a single arc. The curvature R3 of the second arc-shaped surface 35 in the variant example is defined as the curvature radius of the arc along the second arc-shaped surface 35. The connecting portion 36, by being formed into a smoother shape along only a single arc, can more reliably suppress the bounce-back of urine hitting the surface of the bowl portion 6.

The first arc-shaped surface 32 is formed in an arc shape with a curvature radius in the range of 40 mm to 120 mm, and preferably in a curvature range of 50 mm to 100 mm.

The first arc-shaped surface 32 is formed to be left-right symmetrical about the front-to-back axial line A1, and the right-side end portion 32*a* and left-side end portion 32*b* thereof is formed to be positioned within a region within a center angle region D from 20° through 100°, centered on origin point C.

Therefore the first arc-shaped surface 32 is positioned in the area where, among the regions where a urinating user's urine is considered relatively prone to hit the bowl portion 6 in a standing or sitting state, the urinating user's urine is considered relatively prone to hit the bowl portion 6 particularly in a sitting state, i.e., within a center angle region D of 20° through 100°, centered on origin point C. Hence when a large amount of urine hits the first arc-shaped surface 32, the urine is made to flow and drop more easily toward the inside of an arc having a curvature radius of a predetermined size (the inside of the bowl portion 6), and bounce-back toward the user or outside the bowl portion 6, as well as rising of the user's urine along the rim portion to overflow outside the bowl portion from the top edge of the rim portion, is constrained.

Because no (e.g., raised portion of the type interfering with the flow path) is formed, it is possible in the front region 6*a* where no shelf portion 18 is formed to connect the region of the separation line between shelf portion 18 and shelf portion 18 with a certain arc shaped curved surface, connecting to the shelf portion 18 on the downstream side while maintaining a flow seeking to circulate flush water flowing in from the upstream side shelf portion 18, thereby forming a circulating flow.

The second arc-shaped surface 34 is formed in an arc shape with a curvature radius in the range of 40 mm to 120 mm, and preferably in a curvature radius range of 50 mm to 100 mm.

The second arc-shaped surface 34 is formed on the front-to-back axial line A1. The second arc-shaped surface 34 is formed within a range from the rim top surface portion 28 to a height of 140 mm, and more preferably within a range from the rim top surface portion 28 to a height of 120 mm.

The second arc-shaped surface 34 is formed in a range from the height of the shelf portion 18 in the vicinity of the front region 6*a* up to a height at which the top end 34*a* of the second arc-shaped surface 34 is 80 mm above the shelf portion 18, and more particularly 50 mm above the shelf portion 18. The second arc-shaped surface 34 is also formed in a range whereby the bottom end 34*b* of the second arc-shaped surface 34 is at a height up to 80 mm below the shelf portion 18, and more preferably at a height down to 30 mm below the shelf portion 18.

The second arc-shaped surface 34 is formed in a region over the above-described predetermined range; i.e., it is formed into a region in which the urine of a user relieving him/herself in a sitting state is relatively prone to hit.

In such a region where a user's urine is relatively prone to hit the bowl portion 6, no shelf portion is formed in which an upward-facing flat part is formed, and the user's urine can be prevented from bouncing back toward the user himself or outside or above the bowl portion 6, or from rising along the rim portion and overflowing to outside the bowl portion from the top end of the rim portion. Also, in the second arc-shaped surface 34, no shelf portion as described above or other projecting portion is formed; the surface is formed into a concave arc shape, and urine hitting the second arc-shaped surface 34 is made to flow more easily down toward the inside (inside of the bowl portion 6) in an arc having a curvature radius of a predetermined size.

In the front region 6*a* of the bowl portion 6, the ratio of the curvature (curvature radius) R1 of the first arc-shaped surface 32 in the horizontal direction close to the waste-receiving surface 14 top end 14*a* to the curvature (curvature radius) R2 of the second arc-shaped surface 34 in the vertical direction formed by the lower side portion below the top portion of the essentially vertically-rising rim inside wall portion 26, and the waste-receiving surface 14, is in a range of 1:3 to 3:1.

The flush toilet of the present invention can limit bounce-back of urine hitting of the bowl portion inside surface if it has a first arc-shaped surface 32 and a second arc-shaped surface 34, but if applied to flush toilets with a variety of shapes in which the curvature R1 of the first arc-shaped surface 32 and the curvature R2 of the second arc-shaped surface 34 have a relationship in the range of the above-described certain range of ratios, bounce-back of urine hitting the inside surface of the bowl portion can be still more reliably limited.

Also, in the front region 6*a* of the bowl portion 6, when the curvature R1 of the first arc-shaped surface 32 in the horizontal direction close to the waste-receiving surface 14 top end 14*a* and the curvature R2 of the second arc-shaped surface 34 in the vertical direction formed by the lower side portion below the top portion of the essentially vertically-rising rim inside wall portion 26 and the waste-receiving surface 14 are essentially the same, the shapes of the front region 6*a* of the bowl portion 6 in the vertical and horizontal directions are essentially the same shapes and are up-down and left-right symmetrical, therefore bounce-back by urine hitting the inside surface of the bowl portion can be more reliably limited. Even in cases where the part where urine hits gradually changes, bounce-back by urine hitting the inside surface of the bowl portion can be more reliably limited.

In a flush toilet 1 according to the above-described first embodiment of the present invention, in the front region 6*a* of the bowl portion where urine from a user who has relieved himself from a standing state or a sitting state, and particularly from a sitting state, no inwardly projecting part such as a shelf-shaped projecting part is formed, and the ration of the curvature R1 of the first arc-shaped surface 32 in the horizontal direction at the top portion of the waste-receiving surface 14 to the curvature R2 of the second arc-shaped surface 34 in the vertical direction formed by the lower side portion below the top portion of the essentially vertically rising rim inside wall portion 26 and the waste-receiving surface 14 is in a range of 1:3 to 3:1, so that the second arc-shaped surface 34 and first arc-shaped surface 32, concave on the inside in both the horizontal direction and vertical direction, can relatively limit the bounce-back of urine hitting the inside surface of the bowl portion 6. Therefore bounce-back of user urine to the top of the bowl portion 6 and/or outside the bowl portion 6, or bounce-back to the user him/herself sitting over the bowl portion 6, or spraying or outflow from the rim portion 16 to outside the bowl portion 6, can be constrained.

According to the flush toilet 1 of the above-described first embodiment of the present invention, the front region 6*a* of the bowl portion 6 where the urine of a user relieving himself in a sitting position can easily hit is formed in a region within a center angle range from 20° through 100° using an origin point C. In a front region 6*a* of the bowl portion 6, no inwardly projecting part such as a shelf-shaped projecting part is formed, and the inside surface of the arc, formed so that its interior is concave in the same manner in both the horizontal and vertical directions, can relatively constrain the bounce back of urine hitting the inner surface of the bowl portion 6. Therefore bounce-back of user urine to the top of the bowl portion 6 and/or outside the bowl portion 6, or bounce-back to the user him/herself sitting over the bowl portion 6, or spraying or outflow from the rim portion 16 to outside the bowl portion 6, can be constrained.

According to the flush toilet 1 of the above-described first embodiment of the present invention, in the front region 6*a* of the bowl portion 6 where a user's urine can easily hit, no inwardly projecting part such as a shelf-shaped projecting part is formed; the curvature R1 of the first arc-shaped surface 32 and the curvature R2 of the second arc-shaped surface 34 are formed to be essentially the same, so bounce-back of urine hitting the inside surface of the bowl portion 6 can be relatively limited. Therefore bounce-back of user urine to the top of the bowl portion 6 and/or outside the bowl portion 6, or bounce-back to the user him/herself sitting over the bowl portion 6, or spraying or outflow from the rim portion 16 to outside the bowl portion 6, can be more reliably constrained.

Figure 5:
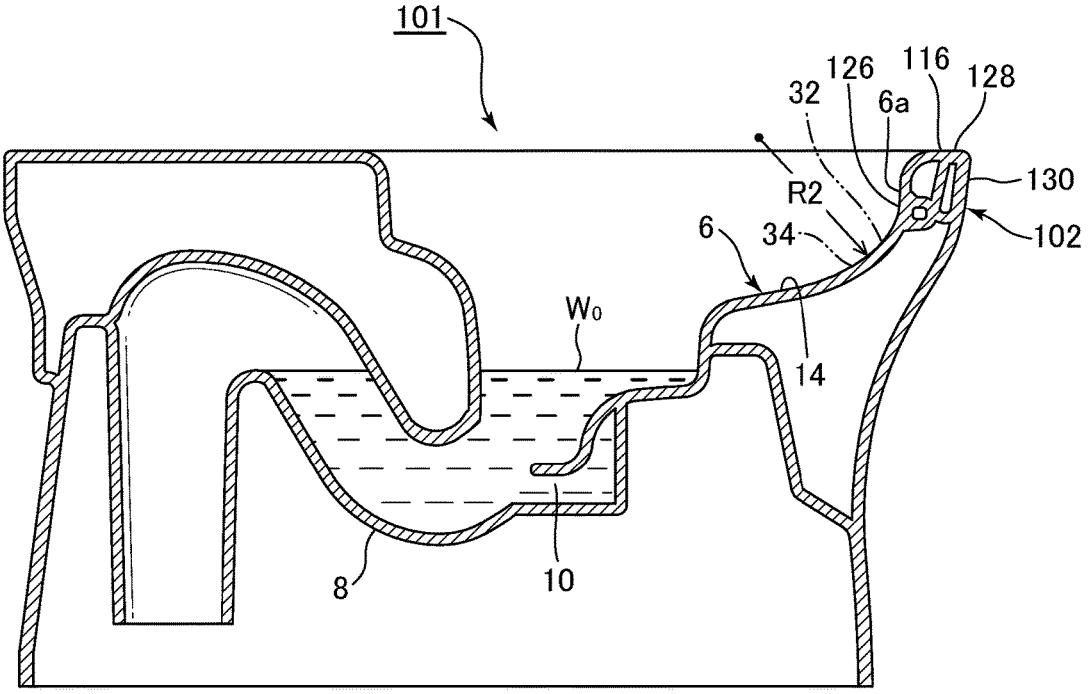
FIG. 5 is a cross sectional view along a center cross section of the main body of a flush toilet, showing a variant example of the rim portion in a flush toilet according to a second embodiment of the present invention.
Figure 6:
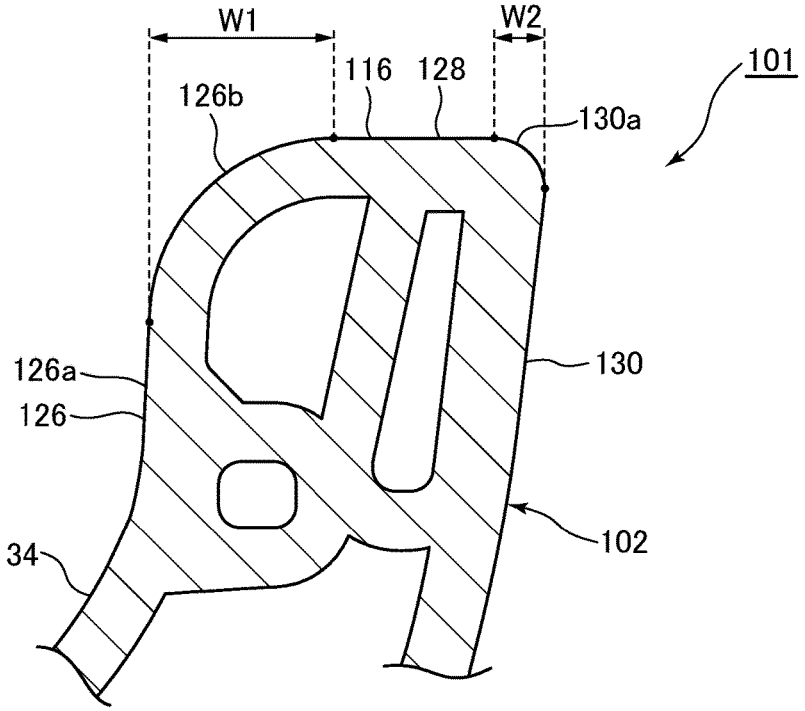
FIG. 6 is an enlarged cross sectional view showing a rim portion at the front portion of the bowl portion shown in FIG. 5.

Next, referring to FIGS. 5 and 6, a flush toilet according to a second embodiment of the present invention is explained.

The second embodiment of the present invention is a flush toilet 101 which forms a sloped surface at the top portion of the rim portion 16.

FIG. 5 is a cross sectional view along a center cross section of the main body of a flush toilet, showing a variant example of the rim portion in a flush toilet according to a second embodiment of the present invention, and FIG. 6 is an enlarged cross sectional view showing a rim portion at the front portion of the bowl portion shown in FIG. 5. Because the flush toilet according to the second embodiment of the present invention has essentially the same structure as the flush toilet according to the above-described first embodiment of the present invention, the elements of the second embodiment which differ from the first embodiment will be explained.

As shown in FIGS. 5 and 6, in the flush toilet 101 according to the second embodiment of the present invention, the rim portion 116 comprises: a rim inside wall portion (inner circumferential surface) 126 forming the inner circumferential surface of the rim portion 116, in which all or a portion from the top end 14*a* of the waste-receiving surface 14 to the top portion of the toilet main body 102 is formed in a vertical wall shape, standing in essentially a vertical direction; a rim top surface portion 128 forming the top surface of the rim portion 116 and forming an essentially horizontally extending plane; and a rim outer wall portion 130 forming the outer circumferential surface of the rim portion 116 and formed in a vertical wall shape rising up the outside surface of the toilet main body 2 up to the rim top surface portion 128.

A rim outer wall portion 130 is provided so that in at least the front region 6*a* of the bowl portion 6, the top end of the top portion region of the rim outer wall portion 130 is connected to a slightly inner-side rim top surface portion 128, and so as to have a rim outer wall top portion sloped surface 130*a*, in which the outside of the top portion region slopes down. The rim inside wall portion 126 has a rim inner wall top portion sloped surface 126*b*, whereby in at least the front region 6*a* of the bowl portion 6, the top end region of the rim inside wall portion 126 is connected to a slightly outside rim top surface portion 128, and the inside of the top portion region (the waste-receiving surface 14 side) slopes downward. The horizontal width W1 of the rim inner wall top portion sloped surface 126*b* is formed to be larger than the horizontal width W2 of the rim outer wall top portion sloped surface 130*a*. The plumb portion 126*a* at the top portion of the rim inside wall portion 126 is connected to the bottom side of the rim inner wall top portion sloped surface 126*b*. In the front region 6*a* of the bowl portion 6, the vertical portion 126*a* at the top portion of the rim inside wall portion 126 is formed to rise in essentially the vertical direction.

The rim outer wall top portion sloped surface 130*a* forms a rounded rim portion between the rim top surface portion 128 and the rim outer wall portion 130. The rim inner wall top portion sloped surface 126*b* forms a rounded shape. Stated another way, it forms an arc shape connecting the rim top surface portion 128 and the rim outer wall portion 130. The rim outer wall top portion sloped surface 130*a* may also be formed by a curved surface which changes continually so as to assume the rounding of the sloped surface formed between the rim top surface portion 128 and the rim outer wall portion 130. Also, the sloped portion gradually connecting the laterally oriented rim top surface portion 128 on the rim outer wall top portion sloped surface 130*a* with the vertically oriented rim outer wall portion 130 may also be formed by a beveled shape, diagonally cutting off the corners. I.e., the area between the rim top surface portion 128 and the rim outer wall portion 130 may be formed by a flat surface at a predetermined angle.

The rim inner wall top portion sloped surface 126*b* forms a sloped portion which smoothly links between the laterally oriented rim top surface portion 128 and a portion of the vertically-oriented plumb portion 126*a*. The rim inner wall top portion sloped surface 126*b* forms a rounded shape projecting toward the center top of the bowl portion 6.

In other words, it forms an arc shape connecting the rim top surface portion 128 and the rim inside wall portion 126. The rim inner wall top portion sloped surface 126*b*, while including a relatively flat surface in a portion of the surface between the rim top surface portion 128 and the rim inside wall portion 126, may also be formed into a bent surface shape so as to assume a roundedness over its entirety. Also, the sloped portion gradually connecting the laterally oriented rim top surface portion 128 on the rim inner wall top portion sloped surface 126*b* with the rim inside wall portion 126 may also be formed by a beveled shape, diagonally cutting off the corners. I.e., the area between the rim top surface portion 128 and the rim inside wall portion 126 may be formed by a flat surface at a predetermined angle.

Since the rim inner wall top portion sloped surface 126*b* is formed on the top portion of the rim inside wall portion 126, a space can be prevented from forming between the user's hand and the rim inner wall top portion sloped surface 126*b* if the user places his or her hand to follow the rim inner wall top portion sloped surface 126*b*, and the hand can be naturally placed so as to follow the curved surface as a whole. Therefore in cases such as cleaning the toilet main body 102 waste-receiving surface 116, the user can naturally place his or her hand to follow the rim inner wall top portion sloped surface 126*b* (including placement of hands through gloves or cleaning tools) with the palm, etc. disposed on the rim top surface portion 128 so as to follow it horizontally, thus facilitating cleaning of the rim inner wall top portion sloped surface 126*b* and the rim inside wall portion 126 without producing a relatively large space between the hand and the rim portion 116. In addition, the user can place the rim top surface portion 128, the rim inner wall top portion sloped surface 126*b*, and the rim inside wall portion 126 in a contacting state without excessive bending of the hand, so the force needed for cleaning can be relatively easily applied to the hand. Hence cleaning ability of the rim top surface portion 128, the rim inner wall top portion sloped surface 126*b*, and the rim inside wall portion 126 is improved.

As shown in FIGS. 5 and 6, in the front region 6*a* of the bowl portion 6, in the vertical direction a second arc-shaped surface 34 is formed by the rim inside wall portion 126 on the bottom side of the plumb portion 126*a* of the rim inside wall portion 126 formed to rise essentially vertically, and the waste-receiving surface 14.

In the second embodiment, as in the first embodiment, in the front region 6*a* of the bowl portion 6, in the horizontal direction a first arc-shaped surface 32 is formed in the horizontal direction close to the top end 14*a* of the waste-receiving surface 14. Also, in the second embodiment, as in the first embodiment, in the front region 6*a* of the bowl portion 6 a spherical curved surface is formed by the rim inside wall portion 126 of the rim portion 116 on the bottom side from the plumb portion 126*a* at the top portion of the rim inside wall portion 126 rising essentially vertically, and the waste-receiving surface 14.

As described above, when a rim inner wall top portion sloped surface 126*b* is formed on the top portion of the rim inside wall portion 126, the height of the plumb portion 126*a* is formed to be relatively low, and the length is formed to be relatively short; furthermore the top portion of the rim inner wall top portion sloped surface 126*b* of the rim inside wall portion 126 is formed to slope outward, so that urination directed toward the front region 6*a* of the bowl portion 6 can easily flow out so as to overflow to the outside of the bowl portion 6 from the rim inner wall top portion sloped surface 126*b* after rising along the plumb portion 126*a*; moreover, because the height of the plumb portion 126*a* of the rim inside wall portion 126 is relatively low, urine can more easily spray toward the outside of the bowl portion 6.

Even in such cases, because of the second arc-shaped surface 34 and the first arc-shaped surface 32 disposed on the bottom side of the rim inner wall top portion sloped surface 126*b* and the plumb portion 126*a*, bounce-back of urine hitting the inside surface of the bowl portion 6 can be relatively constrained, and bounce-back of urine can be relatively constrained in a manner impeding it from passing toward the outside or the top portion of the bowl portion 6. Therefore user urine can be constrained from bounce-back to the user him/herself when sitting above the bowl portion 6, and from flowing out from the top end of the rim portion 116 to outside the bowl portion 6.

In the flush toilet 101 according to a second embodiment of the present invention, as in the flush toilet 1 according to a first embodiment of the present invention, in the front region 6*a* of the bowl portion 6 where a user's urine is prone to hit, no inwardly projecting part such as a shelf-shaped projecting part is formed, and the ratio of the curvature R1 of the first arc-shaped surface 32 to the curvature R2 of the second arc-shaped surface 34 is in a range of 1:3 to 3:1, and the arc-shaped inside surface, formed so that its interior is concave in the same manner in both the horizontal and vertical directions, can relatively constrain the bounce-back of urine hitting the surface of the bowl portion 6.

Therefore bounce-back of user urine to the top of the bowl portion 6 and/or outside the bowl portion 6, or bounce-back to the user him/herself sitting over the bowl portion 6, or spraying or outflow from the rim portion 116 to outside the bowl portion 6, can be constrained.

Also, according to the flush toilet 101 of the above-described second embodiment of the present invention, the width W1 in the horizontal direction of the rim inner wall top portion sloped surface 126*b* is formed to be larger than the width W2 in the horizontal direction of the rim outer wall top portion sloped surface 130*a*, and when seeking to improve visibility to users so that the top portion of the waste-receiving surface 14 appears to widen to the outside, and to improve user cleaning ability of the rim portion 116, a rim inner wall top portion sloped surface 126*b* is formed at the top portion of the rim inside wall portion 126 in the front region 6*a* of the bowl portion 6 of the rim inside wall portion 126, therefore the height of the top portion of the inner circumferential surface rising in essentially a plumb direction on the rim portion 116 is formed to be relatively low, and to that extent urine is more prone to spray or flow out to the outside of the bowl portion 6. In the present invention the arc-shaped inside surface, formed to be concave in the same manner in both the horizontal and vertical directions, can relatively constrain the bounce-back of urine hitting the inner surface of the bowl portion 6 even in flush toilets 101 comprising a rim portion 116 having the type of rim inner wall top sloped surface 126*b*. Therefore bounce-back of user urine to the top of the bowl portion 6 and/or outside the bowl portion 6, or bounce-back to the user him/herself sitting over the bowl portion 6, or spraying or outflow from the rim portion 116 to outside the bowl portion 6, can be constrained.

What is claimed is:

1. A flush toilet for cleaning a toilet main body and discharging waste by using flush water supplied from a flush water source, comprising:

a bowl portion including a bowl shaped waste-receiving surface and a rim portion formed on a top edge of the waste-receiving surface;

a discharge path configured to discharge the waste, an inlet of the discharge path being connected to a bottom of the bowl portion;

a spouting portion configured to spout the flush water to the bowl portion and form a circulating flow of the flush water;

a water conduit configured to supply the flush water to the spouting portion; and a water supply apparatus for supplying the flush water to the water conduit;

wherein the bowl portion contains a front region in which a plumb portion does not project inwardly toward a rear of the bowl, the front region including a first arc-shaped surface having a curvature R1 in a horizontal direction of a top portion of the waste-receiving surface and a second arc-shaped surface having a curvature R2 in a vertical direction formed by a lower side of the inner circumferential surface of the rim portion and the waste-receiving surface, and the ratio of the curvature R1 to the curvature R2 is in a range of 1:3 to 3:1.

2. The flush toilet according to claim 1, wherein the front region of the bowl portion is formed in a region within a center angle range from 20° through 100° using an origin point as a center, the origin point being defined by an intersection of a front-to-back axial line dividing an bowl opening of the bowl portion into two equal parts left and right with a left-to-right axial line dividing the bowl opening into two equal parts front and back.

3. The flush toilet according to claim 1, wherein the curvature R1 and the curvature R2 are formed to be substantially the same.

4. The flush toilet according to claim 1, wherein the rim portion includes a rim top surface portion forming a top surface of the rim portion, a rim outer wall portion forming an outer circumference surface of the rim portion, and a rim inner wall portion forming an inner circumference surface of the rim portion; and wherein, in the front region of the bowl portion, the rim outer wall portion has a sloped surface in which a top region of the rim outer wall portion slopes downward, the rim inner wall portion has a sloped surface in which a top region of the rim inner wall portion slopes downward, and a horizontal width of the sloped surface of the rim inner wall portion is formed to be larger than a horizontal width of the sloped surface of the rim outer wall portion.

* * * * *